US006429253B1

(12) United States Patent
Guerro et al.

(10) Patent No.: US 6,429,253 B1
(45) Date of Patent: Aug. 6, 2002

(54) PAPERMAKING METHODS AND COMPOSITIONS

(75) Inventors: Gerald J. Guerro, Trumbull; Leigh Ann Lawrence, West Hartford, both of CT (US)

(73) Assignee: Bayer Corporation, Pittsburgh, PA (US)

( * ) Notice: Subject to any disclaimer, the term of this patent is extended or adjusted under 35 U.S.C. 154(b) by 0 days.

(21) Appl. No.: 09/571,142

(22) Filed: May 16, 2000

Related U.S. Application Data

(63) Continuation of application No. 08/801,048, filed on Feb. 14, 1997, now abandoned.

(51) Int. Cl.[7] ..... C08L 77/06; D21H 17/33

(52) U.S. Cl. ..... 524/514; 524/500; 524/519; 524/538; 524/551; 524/555; 162/164.1; 162/164.3; 162/164.6; 162/168.2

(58) Field of Search ..... 524/514, 500, 524/551, 555, 519, 538

(56) References Cited

U.S. PATENT DOCUMENTS

| | | | | |
|---|---|---|---|---|
| 2,884,058 A | | 4/1959 | Schuller et al. | 162/168 |
| 2,926,116 A | | 2/1960 | Keim | |
| 2,926,154 A | | 2/1960 | Keim | 260/29.2 |
| 3,556,932 A | | 1/1971 | Coscia et al. | 162/166 |
| 3,733,290 A | | 5/1973 | Williams et al. | |
| 4,233,411 A | | 11/1980 | Ballweber et al. | 525/155 |
| 4,566,943 A | | 1/1986 | Hansson et al. | 162/168.2 |
| 4,605,702 A | | 8/1986 | Guerro et al. | 525/254 |
| 4,722,964 A | | 2/1988 | Chan et al. | 524/608 |
| 5,032,226 A | * | 7/1991 | Winiker | 162/158 |
| 5,427,652 A | | 6/1995 | Darlington et al. | 162/164.3 |
| 5,466,337 A | | 11/1995 | Darlington et al. | 162/164.3 |
| 5,674,362 A | * | 10/1997 | Underwood | 162/164.3 |

FOREIGN PATENT DOCUMENTS

| | | |
|---|---|---|
| WO | WO 97/30221 | 8/1997 |

* cited by examiner

*Primary Examiner*—Fred Zitomer
(74) *Attorney, Agent, or Firm*—Joseph C. Gil; Richard E. L. Henderson

(57) ABSTRACT

Papermaking processes are provided which utilize mixtures of wet strength agents and dry strength agents in amounts that provide paper formed therefrom with decreased wet strength, and hence increase repulpability, without unduly compromising dry strength. Stable compositions comprised of mixtures of wet strength agents and dry strength agents, are also provided which may be advantageously used in said processes.

5 Claims, No Drawings

PAPERMAKING METHODS AND COMPOSITIONS

This application is a continuation of Ser. No. 08/801,048, filed Feb. 14, 1997 abandoned.

BACKGROUND OF THE INVENTION

The present invention relates to mixtures of polymers with improved stability which may be used in a papermaking process to provide paper which is readily repulpable, yet still exhibits adequate wet and dry strength.

Paper is typically manufactured with chemical additives which tend to improve various paper properties e.g. sizing, wet strength, dry strength, etc. Additives which provide wet strength (wet strength agents) may be classified as being either "permanent" or "temporary," based on the permanence of the wet strength they provide. Temporary wet strength agents are generally distinguished from permanent wet strength agents in that they provide a certain degree of wet strength immediately e.g. 5–40 seconds after the paper is wetted, but a good portion e.g. 30–75% of this immediate wet strength is lost after 30 minutes soaking in water, depending on the soaking conditions. In contrast, the immediate wet strength of a paper treated with a permanent wet strength agent tends to decay much more slowly and may often be considered permanent for many practical purposes.

A number of chemical treatments have been used to impart wet strength to paper, including polymers based on melamine-formaldehyde (MF) e.g. those disclosed in U.S. Patent No. 4,461,858, as well as synthetic cationic polymers based on polyamide epichlorohydrin, polyamine epichlorohydrin, and polyamide-amine epichlorohydrin (collectively PAE). For instance, wet strength agents based on PAE are disclosed in U.S. Pat. Nos. 2,926,116; 2,926,154; 3,733,290; 4,566,943; and 4,722,964. Specific temporary wet strength agents are disclosed in U.S. Pat. Nos. 3,556,932 and 4,605,702. All of the foregoing patents are hereby incorporated herein by reference.

As a result of the heightened awareness and increased demand for paper products containing recovered cellulose fiber, efforts have been undertaken to develop paper products which are more readily recyclable. Commercially available wet strength paper products are often difficult to repulp because they utilize relatively high levels of permanent wet strength agents. Although the formulation of paper with temporary wet strength agents would appear to be a solution to this problem, in actual practice difficulties may be encountered because the immediate wet strength obtained with temporary wet strength agents is often disadvantageously less than that obtained with permanent wet strength agents. Also, delays in repulping may be encountered because of the time necessary for the wet strength to decay. In addition, since temporary wet strength agents typically contain reactive functional groups, they may have poor stability as evidenced by a tendency to gel or become water-insoluble on storage. Polymers solutions which have gelled, or a in the late stages of the gelling process, are no longer pourable and thus may present handling difficulties. While gelling may be partially mitigated by reducing the polymer solids of the polymer solution, this presents commercial disadvantages such as increased shipping and storage costs.

In the past, paper having greater repulpability has been produced using commercially available blends of permanent and temporary wet strength agents, and U.S. Pat. Nos. 5,427,652 and 5,466,337 disclose blends of permanent and temporary wet strength agents. However, in some cases the stability of such a blend may be disadvantaged by the inclusion of a reactive temporary wet strength agent. Moreover, there is in most cases an expectation that blending will compromise some other desirable property that is provided by one or the other component. In general, the expectation is based on the well-known "rule of mixtures," which states that any particular property of a mixture is a weighted average of the properties of the individual components making up the mixture, see e.g. "Predicting the Properties of Mixtures: Mixture Rules in Science and Engineering," Lawrence E. Nielson, Marcel Dekker, Inc. 1978, pp. 5–9, as well as U.S. Pat. Nos. 5,496,295; 5,476,531; 5,277,245 and 4,926,458.

It is therefore an object of the instant invention to provide novel wet strength compositions that remain pourable for extended periods of time, methods for utilizing said compositions in papermaking, as well as paper having reduced wet strength (and therefore increased repulpability) without having unduly compromised dry strength, or, in the case of multi-ply paperboard, without having unduly compromised dry ply bonding strength

SUMMARY OF THE INVENTION

It has now been found that compositions comprised of wet strength agents and dry strength agents may, when prepared according to the teachings herein, remain pourable for extended periods of time. It has also been found that effective proportions of wet strength agents and dry strength agents may, when used in papermaking according to the teachings herein, provide paper having lower wet strength without unduly compromised dry strength. Therefore, according to the instant invention, there is provided paper comprised of (a) cellulosic fibers, (b) a polymeric cationic wet strength agent, and (c) a synthetic polymeric cationic dry strength agent different from said wet strength agent, having from about 1 to about 15% of cationic recurring units, by mole based on total moles of recurring units; wherein the amounts of said (a), (b) and (c) are effective to provide said paper with an immediate wet strength that is less than the immediate wet strength of a comparable paper in which only (b) is used in place of (b) and (c); and wherein the amounts of said (a), (b) and (c) are effective to provide said paper with a dry strength that is greater than the expected dry strength based on the rule of mixtures.

In another embodiment of the instant invention, there are provided compositions comprised of (a) a polymeric cationic wet strength agent, (b) a synthetic polymeric cationic dry strength agent different from said wet strength agent, having from about 1 to about 15% of cationic recurring units, by mole based on total moles of recurring units, and (c) water, wherein the weight ratio of said (a) to said (b) is in the range of about 1:4 to 4:1, and wherein a sample of said composition, prepared by mixing (a) and (b) in water to provide a 15% solids composition, by weight based on total weight, remains pourable for at least about 25 days after preparation when stored at about 35° C.

In another embodiment of the instant invention, there are provided methods comprising (a) providing a paper stock, (b) mixing (i) a polymeric cationic wet strength agent, and (ii) a synthetic polymeric cationic dry strength agent different from said wet strength agent, with said paper stock to form an admixture, (c) forming a web from said admixture, and (d) forming a paper from said web; wherein said (ii) has from about 1 to about 15% of cationic recurring units, by mole based on total moles of recurring units; wherein the amounts of said (i), (ii) and paper stock are effective to provide said paper with an immediate wet strength that is less than the immediate wet strength of a comparable paper in which only (i) is used in place of (i) and (ii), and wherein the amounts of said (i), (ii) and paper stock are effective to provide said paper with a dry strength that is greater than the expected dry strength based on the rule of mixtures.

DETAILED DESCRIPTION OF THE INVENTION

As used herein, "paper" is a general term that includes sheet-like masses and molded products made from fibrous cellulosic materials which may be derived from both natural and/or synthetic sources. Paper may be prepared from any aqueous suspension of cellulose fiber and may contain other fibrous matter such as organic, inorganic, or synthetic fibers. Specific examples of paper include printing and writing papers, absorbent papers, tissue, towel, paperboard, linerboard medium, container board, or boxboard, any of which may be coated or uncoated. Paper may be formed from cellulosic fibers derived from any fiber source including, but not limited to, any bleached or unbleached hardwood or softwood chemical, mechanical or chemimechanical pulp, as well as recycled fiber from sources such as old corrugated container board (OCC), recycled newsprint, etc. Preferably, paper is formed from recycled fiber.

The polymeric cationic wet strength agents of the instant invention are generally polymers which, when added to a papermaking process, improve the immediate wet strength of paper produced therefrom by about 10% or more, preferably about 15% or more. Wet strength agents also tend to improve the wet strength to dry strength ratio of paper. Generally, paper which does not contain any wet strength agent has a very low ratio of wet strength to dry strength. The polymeric cationic wet strength agents of the instant invention are generally polymers which, when added to a papermaking process, provide the paper with an immediate wet strength that is about 10% or more, preferably about 15% or more, of the dry strength of the paper. Polymeric cationic wet strength agents may be permanent or temporary, preferably permanent. The permanent wet strength agents used in practicing the invention may be aminoplast polymers conventionally used in the papermaking art e.g., urea-formaldehyde and melamine-formaldehyde, but are preferably polyamine-epichlorohydrin, polyamide epichlorohydrin or polyamide-amine epichlorohydrin polymers (collectively "PAE"). A typical melamine-formaldehyde polymer is commercially available from Cytec Industries, Inc. under the tradename Paramel HE®. Representative examples of polymeric cationic wet strength agents are described throughout the literature. See, for example, "Wet Strength in Paper and Paperboard," TAPPI Monograph Series No. 29, Tappi Press (1952) John P. Weidner, Editor, Chapters 1, 2 and 3; U.S. Pat. Nos. 2,345,543; 2,926,116; 2,926,154; etc. Numerous permanent polymeric cationic wet strength agents are commercially available. Typical examples of some preferred commercially available permanent polymeric cationic wet strength agents include the PAE products sold by Hercules under the tradename Kymene®, e.g., Kymene® 557H, by Georgia Pacific Resins under the tradename Amres®, e.g., Amres 8855®, and by Henkel under the tradename Fibrabon® e.g. Fibrabon 36®, wet strength agents.

Temporary wet strength agents also useful in the instant invention include dialdehyde starch, polyethyleneimine, mannogalactan gum, dialdehyde mannogalactan and cationic glyoxalated polyacrylamide. Glyoxalated polyacrylamide temporary wet strength agents useful herein are described in U.S. Pat. No. 3,556,932 to Coscia. These polymers are typically reaction products of glyoxal and preformed water soluble acrylamide polymers. Suitable polyacrylamide copolymers include those produced by copolymerizing a (meth)acrylamide and a cationic monomer such as 2-vinylpyridine, 2-vinyl-N-methylpyridinium chloride, diallyldimethyl ammonium chloride, etc. Reaction products of acrylamide diallyldimethyl ammonium chloride in a molar ratio of 99:1 to 75:25 glyoxal, and polymers of methacrylamide and 2-methyl-5-vinylpyridine in a molar ratio of 99:1 to 50:50, and reaction products of glyoxal and polymers of vinyl acetate, acrylamide and diallyldimethyl ammonium chloride in a molar ratio of 8:40:2 are more specific examples provided by Coscia. These acrylamide polymers may have a molecular weight up to 1,000,000, but polymers having molecular weights less than 25,000 are preferred. The acrylamide polymers are reacted with sufficient glyoxal to provide a water-soluble thermoset polymer. In most cases the molar ratio of glyoxal derived substituents to amide substitutes in the polymer is at least 0.06:1 and most typically about 0.1:1 to 0.2:1 A preferred temporary wet strength agent has the tradename Parez 631NC® and is sold by Cyteo Industries, Inc.

Polymeric cationic dry strength agents are generally polymers which, when added to a papermaking process, improve the dry strength of paper produced therefrom by about 10% or more, preferably about 15% or more. Preferred dry strength agents do not increase the wet strength of paper, or only increase it by about 15% or less, preferably 10% or less. Polymeric cationic dry strength agents may be natural or derived from natural products e.g. starch, natural gum, etc. Preferably, polymeric cationic dry strength agents are synthetic; generally, they are water-soluble vinyl-addition polymers made by copolymerizing monomers such as acrylamide with cationic comonomers e.g. diallyidialkylammonium halides, acid or quaternary salts of dialkylaminoalkly(alk)acrylate, acid or quaternary salts of dialkylaminoalkly(alk)acrylamide, etc. Specific examples of cationic comonomers include diallyldimethylammonium chloride, the methyl chloride quaternary salt of dimethylaminoethyl(meth)acrylate, and the methyl chloride quaternary salt of dimethylaminoethyl(meth)acrylamide. Alternatively, synthetic polymeric cationic dry strength agents may be formed by post-reaction of ionic or nonionic polymers, e.g. Mannich reaction of polyacrylamide, optionally followed by quaternization, copolymerization of vinyl acetate with known cationic monomers followed by hydrolysis to form vinyl alcohol recurring units, etc. Preferably, synthetic polymeric cationic dry strength agents are so-called "cationic polyacrylamides", polymers which contain recurring acrylamide units and recurring cationic units. More preferably, synthetic polymeric cationic dry strength agents are copolymers of acrylamide with diallyidialkylammonium halide, most preferably copolymers of acrylamide with diallyidimethylammonium chloride (DADM). A particularly preferred cationic polyacrylamide is a copolymer containing about 10% DADM recurring units and about 90% acrylamide recurring units, by weight based on total weight. Numerous dry strength agents are commercially available, or may be synthesized by well-known methods, preferably by solution polymerization using free radical initiation. Solution polymerization methods are well-known in the art, see e.g. "Principles of Polymer Science," G. Odian., $2^{nd}$ Edition, 1981, pp. 194–215, hereby incorporated herein by reference. Solution polymerizations typically involve the polymerization or copolymerization of the monomers in substantially deoxygenated water, optionally in the presence of additives such as chain transfer agent, branching agent, pH adjusting agent, chelating agent, etc. Typical polymerization initiators include redox, thermal, and photochemical initiators.

Although the level of cationic comonomer in the synthetic polymeric cationic dry strength agents useful in the instant invention may be higher than 15% or even 25%, by mole based on total moles of recurring units, in practice lower levels of cationic comonomer content are usually preferred because of the desire for the dry strength agent to be FDA-approved. The United States Food and Drug Administration (FDA) requires that polymers used in certain paper applications meet stringent standards when that paper is likely to come into contact with food. Therefore, preferred synthetic polymeric cationic dry strength agents are FDA-approved, more preferably FDA-approved for use as dry strength agents in the production of paper and paperboard in contact with food, most preferably FDA-approved for use as dry strength agents in the production of paper and paperboard in contact with fatty and aqueous foods under the provisions of 21 CFR 176.170, or for use as dry strength agents in the production of paper and paperboard in contact with dry foods under the provisions of 21 CFR 176.180. Therefore, the level of cationic comonomer in the synthetic polymeric cationic dry strength agent component of the instant invention is preferably about 15% or less, more preferably about 10% or less, most preferably about 5% or less, by mole based on total moles of recurring units, and preferably about 1% or more, more preferably about 3% or more, same basis.

The molecular weights of synthetic polymeric cationic dry strength agents are generally about 50,000 or greater, preferably about 100,000 or greater, more preferably about 250,000 or greater. Although polymers having molecular weights above about 1,000,000 could be used, the viscosity of very high molecular weight polymer solutions may negatively impact pourability, possible leading to formulations having decreased polymer solids. Therefore, molecular weights below about 1,000,000 are generally preferred. Molecular weights are weight average and may be determined by methods well known to those skilled in the art including light scattering, size exclusion chromatography, etc. The synthetic polymeric cationic dry strength agents useful in the instant invention may have various molecular architectures, including linear, branched, star, block, graft, etc.

It is known in the industry that the presence of anionic species in the pulp may have a deleterious effect on the efficiency of the wet strength agent, which is usually cationic. In some cases, this adverse impact can be reduced by treating the paper stock with cationic polymers known in the industry as cationic promoters. Some examples of cationic promoters are polyethyleneimine, quaternized polyamines such as polydiallyldimethylammonium chloride, cationic starch and specific commercial products available from Cytec Industries, Inc. under the trade names CYPRO® 514, 515, and 516. Cationic promoters are not synthetic polymeric cationic dry strength agents for the purposes of the instant invention because they are not polymers which, when added to a papermaking process, improve the dry strength of paper produced therefrom by 10% or 15% or more. Cationic promoters are also distinguished in that they tend to have lower molecular weights than dry strength agents and also because they are generally added to the paper stock well in advance of the wet strength agents to ensure adequate mixing and adequate contact with the fibers. In contrast, the dry strength agents of the instant invention are preferably added to the paper stock at substantially the same time as the wet strength agents.

Dry strength, immediate wet strength and dry ply bonding strength may all be measured in the usual way by means well known to those skilled in the art. Preferably, dry strength is measured in accordance with TAPPI Test Method T 494 om-88, immediate wet strength is measured in accordance with TAPPI Test Method T 456 om-87, and dry ply bonding strength is measured in accordance with TAPPI Test Method T 541 om-89, as described in the Examples below. Most preferably, numerous samples are tested so that the strength of a particular paper is determined by averaging the results of a number of individual tests in a statistically valid fashion.

By blending amounts of a polymeric cationic wet strength agent and a polymeric cationic dry strength agent, compositions useful in papermaking are obtained. Although these compositions could in theory be prepared by mixing solutions or emulsions of the polymers and drying the resulting blend to produce a powdered polymer product, or by drying the polymers individually and blending the resulting powders, in practice it may be energy-inefficient to remove the water and also impractical because the user may need to invest in equipment suited to redissolving the powdered polymer for use. Therefore, the compositions of the instant invention are generally comprised of a polymeric cationic wet strength agent, a polymeric cationic dry strength agent, and water, and generally have a polymer solids level of about 5% or greater, more preferably about 10% or greater, most preferably about 15% or greater, by weight based on total weight. Preferably, the instant compositions are stable e.g. the ability of the components to function as desired is not unduly compromised by storage, and the composition itself remains pourable for extended periods of time. Both pourability and stability tend to be influenced by temperature. total polymer solids level, and by the relative reactivities of the components. For instance, when polymer solutions are comprised of a cationic temporary wet strength agent and a polymeric cationic dry strength agent, the solids level must often be kept at relatively low levels if long-term stability is desired because of the tendency for pourability to be adversely affected by gelation. The rate of such gelation is often accelerated by higher temperatures, higher total polymer solids content, and by higher levels of more reactive components. Since temporary wet strength agents tend to contain reactive functional groups, it follows that the inclusion of a temporary wet strength agent in the mixture can, in some cases, compromise stability. Therefore, it is generally preferred, when storage stability and pourability of the composition are desired, for both the dry strength agent and the wet strength agent to be relatively non-reactive towards one another. In practice, this means that permanent wet strength agents such as PAE are preferred over permanent wet strength agents based on melamine-formaldehyde chemistry, and also over temporary wet strength agents such as those formulated with reactive components e.g. dialdehyde, glyoxal, etc. The same considerations apply with respect to total solids level because gelation tends to be faster at higher solids levels. In commercial practice, good pourability may mean that a sample polymer composition, prepared by mixing cationic wet strength agent and cationic dry strength agent in water to provide a 15% solids composition, by weight based on total weight, remains pourable for about 25 days or more, preferably 30 days or more, after preparation when stored at about 35° C. For purposes of the instant invention, a composition remains pourable if it has a syrupy consistency e.g. a bulk viscosity of about 5,000 centipoise (cps) or less, preferably about 2,000 cps or less, most preferably about 1,500 cps or less, as measured with a rotating cylinder viscometer e.g. Brookfield viscometer at 25° C. as described in the Examples below. A polymer solution that has gelled is no longer considered pourable for present purposes, even if some spurious viscosity reading could be obtained by forcing the viscometer into the gelled mass.

Commercially, wet strength agents are not usually used for dry strength development because wet strength agents tend to complicate broke recovery. When used together, it is understood that the dry strength agent and the wet strength agent are different polymers, even where, for instance, the wet strength agent provides both dry strength and wet strength and could therefore be classified as both a dry strength agent and a wet strength agent. In this context, the polymers are different if they are physically or chemically distinguishable, e.g. of different chemical structure or composition, different molecular weight, etc.

The wet strength agents and dry strength agents of the instant invention may be mixed with a paper stock in any order to form an admixture, which is then subsequently formed into paper by well-known processes, typically involving the intermediate step of web formation. For instance, to prepare the paper of the instant invention, a paper stock, typically having a consistency of about 0.1 to 1.0% is prepared. The point of addition of the wet strength and dry strength polymers can vary depending on the design of the papermaking machine and the nature of the paper product as long as the polymers have an adequate opportunity to contact the fiber before the sheet is formed. The wet strength and dry strength agents can be added at any point before the head box, such as in the stock chest, refiners, or fan pump. The admixture of paper stock, wet strength agent. and dry strength agent is then typically formed into a web, from which the paper is subsequently formed. Preferably the wet strength agent and dry strength agent are pre-mixed to form a composition that is preferably stable, as described above.

The amounts of wet strength agent, dry strength agent, and paper stock are generally those that are effective to provide the resulting paper with an immediate wet strength that is less than the immediate wet strength of a comparable paper in which only the wet strength agent is used in place of the wet strength agent and dry strength agent combined. As used herein, a "comparable paper" is one which is made in a substantially identical fashion except that only the particular wet strength agent is used in place of the total amount of wet and dry strength agent. The amounts of wet strength agent, dry strength agent, and paper stock are also generally those that are effective to provide the paper with a dry strength that is greater than the expected dry strength based on the rule of mixtures. Thus, the wet strength of a paper, made with a particular amount of wet strength agent and without a dry strength agent, may be reduced by replacing the wet strength agent with the same amount of a combination of wet strength agent and dry strength agent. Surprisingly, when effective amounts of the combination of wet strength agent and dry strength agent are used, the dry strength of the paper is higher than that expected based on the rule of mixtures. Preferably, amounts of wet strength agent generally range from about 0.05 to about 1%, by weight based on the total weight of the paper. Likewise, preferred amounts of dry strength agent also generally range from about 0.05 to about 1%, by weight based on the total weight of the paper. In many cases, preferred amounts of wet strength agent and dry strength agent depend on the degree of repulpability desired. Generally, easier repulpability may be achieved by the use of lesser amounts of wet strength agent, so that it is frequently desirable to use more dry strength agent than wet strength agent. The ratio of wet strength agent to dry strength agent is generally in the range of about 1:4 to about 4:1, preferably about 1:3 to about 3:1, most preferably about 2:3 to about 3:2, although amounts effective to achieve the above stated effects may sometimes be somewhat outside of these ranges. For instance, since pulp contains a natural product and may vary from batch to batch, amounts of pulp, wet strength agent, and dry strength agent that are effective under a particular set of production conditions may not be effective under different production conditions, so it is recognized that a certain amount of routine experimentation may be needed to determine effective amounts. Wet strength and dry strength agents are generally recommended for use within a predetermined pH range which will vary depending upon the nature of the polymer. For example, the Amres® wet strength agents referred to above are typically used at a pH of about 4.5 to 9. The generally recommended pH requirements for the particular polymer should also be utilized in the present invention. A pH in the range of about 6 to about 8 is preferred. Paper prepared in accordance with the invention may also incorporate other additives conventionally used in the paper industry such as sizes, fillers, etc.

In the case of multi-ply paperboard, lower wet strength may also be achieved by utilizing. amounts of wet strength agent, dry strength agent, and paper stock that are effective to provide the resulting paperboard with an immediate wet strength that is less than the immediate wet strength of a comparable paper in which only the wet strength agent is used in place of the wet strength agent and dry strength agent combined. The amounts of paper stock, wet strength agent and dry strength agent used are also effective to provide the paperboard with a dry ply bonding strength that is greater than the expected dry ply bonding strength based on the rule of mixtures.

The "rule of mixtures" refers to a means for determining the hypothetical value for a given physical property of a blend or mixture of two or more polymers. The hypothetical value represents the summation of the proportional contribution of the actual values of the physical property from each of the constituent polymers, based on the weight percents of the constituent polymers incorporated into the blend. Under the "rule of mixtures," the value for a given physical property (Property "X") of a blend of two polymers (Polymers A & B) can be calculated according to the following formula: Hypothetical value of property "X" for a blend of Polymers A & B=(Weight percent of polymer A in the blend)×(actual value of property "X" for Polymer A)+(Weight percent of polymer B in the blend)×(actual value of property "X" for Polymer B).

It is a feature of the instant invention that paper containing effective amounts of dry strength agent, wet strength agent and cellulosic fiber may be produced that has a reduced wet strength, and hence is typically more easily repulpable, when compared to a comparable paper having just the wet strength agent in place of the combination of wet strength agent and dry strength agent. It is also a feature of the instant invention that this paper has a dry strength, (and dry ply bonding strength in the case of paperboard) that is greater than that expected based on the rule of mixtures. These features may be illustrated, as in the Examples below, by preparing three sets of otherwise substantially identical papers, each having the same amount of total polymer, except that the first (comparable) paper is prepared using the wet strength agent only; the second is prepared using effective amounts of cellulosic fiber, the same wet strength agent as the first paper, and dry strength agent; and the third is prepared using the dry strength agent only. The immediate wet strengths and dry strengths of the three sets of paper are then determined in the usual fashion. When prepared in accordance with the instant invention, the wet strength of the second paper is desirably lower than the wet strength of the first paper, yet, surprisingly, the dry strength of the second paper is greater than the expected dry strength, based on the rule of mixtures and the dry strength results obtained on the first and third sets of paper. Therefore, it is an advantage of the instant invention that paper may be made that has reduced wet strength (and therefore increased repulpability) without having unduly compromised dry strength It is another feature of the instant invention that preferred mixtures of wet strength agent and dry strength agent are stable and resist gelation to a much greater degree than, for instance, mixtures which include glyoxal-containing temporary wet strength agents or melamine-formaldehyde-based wet strength agents. Therefore, it is an advantage of the instant invention that higher solids products may be prepared, or products having equivalent polymer solids but increased shelf life. Both of these advantages are highly desirable from a commercial standpoint.

The following illustrative Examples are not intended to limit the scope of the instant invention.

General Handsheet Procedure: To an aqueous pulp suspension of about 0.6% (by weight) consistency composed of 1:1 hardwood:softwood fibers beaten to Canadian Standard Freeness (CSF) of about 450–550 milliliters (ml), at the pH indicated below, was added the diluted (typically 1% by weight) dry strength agent and wet strength agent to provide a dosage as indicated below, reported in units of pounds per ton (lb./T), based on dry fiber. The pH was readjusted to the initial pH and the mixture was stirred briefly to facilitate contact between the polymer and the fiber. This mixture was then used to prepare several eight inch-by-eight inch webs ("handsheets") having the basis weight indicated below using a stationary deckle papermaking machine (Noble and Wood). Paper was then formed by pressing the webs between blotters (under 15 psi pressure), drying on a rotary drum drier for one minute at 115° C., post-curing for 3 minutes at 105° C., and conditioning overnight at 25° C. and 50% relative humidity.

General Multi-Ply Handsheet Procedure: To make multi-ply paper for dry ply bonding tests, two 50 pound basis weight webs were prepared as above, except that the polymer dosage was split with approximately half going to each web. Multi-ply paper was then formed by pressing the two webs together between the blotters (under 25 psi pressure), drying on a rotary drum drier for one minute at 115° C., post-curing for 3 minutes at 105° C., and conditioning overnight at 25° C. and 50% relative humidity.

Since it is derived from a natural product, pulp tends to vary so that different strength results may be obtained from different batches of pulp. Therefore, the same pulp was generally used for each set of comparative experiments and a blank was generally done for each set. To make the blank samples, the above procedures were followed except that no wet strength or dry strength agents were added.

General Tensile Test Procedures: Immediate wet strength was determined by tensile tests conducted in accordance with TAPPI Test Method T 456 om-87. Immediate wet strength is the tensile strength retained after the paper has been wet 5–40 seconds. Dry strength was determined by tensile tests conducted in accordance with TAPPI Test Method T 494 om-88. Dry ply bonding strengths were determined by tensile tests conducted in accordance with TAPPI Test Method T 541 om-89. Generally, each strength result below represents the average of about 6–12 individual tensile tests. Results below are reported in units of pounds per inch (lb./in.) for wet and dry tensile tests, and in units of mil foot pounds (mil-ft.-lb.) for dry ply bonding strength tests.

General Blend Preparation Procedure: Blends of dry strength agent and wet strength agent were prepared from polymer solutions by adding one solution to the other, diluting to the desired polymer solids level, and stirring for about one hour.

The acrylamide/DADM copolymer used in the Examples below was prepared by solution polymerization of a 95/5 (weight ratio) mixture of acrylamide and DADM in water, using amounts of free radical initiator and methylenebisacrylamide sufficient to result in an acrylamide/DADM copolymer with a molecular weight of about 250,000. The PAE, glyoxalated polyacrylamide and melamine-formaldehyde (MF) polymers were obtained commercially.

EXAMPLES 1–10

A blend was prepared by the General Blend Preparation Procedure, using a commercially available PAE as the wet strength agent and 95/5 acrylamide/DADM copolymer as the dry strength agent, in the proportions indicated in Table 1. Paper was formed by the General Handsheet Procedure at two different pH levels and at an total polymer dosage of about 5 pounds/ton to form 70 pound basis weight sheets. Comparable paper, in which the wet strength agent alone was used in place of the blend, was also formed by the General Handsheet Procedure at two different pH levels and at a dosage of about 5 pounds/ton to form 70 pound basis weight sheets. The results demonstrate the amounts of wet strength agent, dry strength agent and paper stock that are effective to provide paper with an immediate wet strength that is less than the immediate wet strength of a comparable paper in which only the wet strength agent is used in place of the blend, and the amounts of wet strength agent, dry strength agent and paper stock that are effective to provide the paper with a dry strength that is greater than the expected dry strength based on the rule of mixtures.

TABLE 1

| No. | Polymer | pH | Immediate Wet Strength, lb./in. | Dry Strength, lb./in. |
|---|---|---|---|---|
| 1C | None (Blank) | 6 | 0.91 | 23.1 |
| 2C | PAE (Comparable) | 6 | 5.3 | 26.1 |
| 3 | PAE/95/5 acrylamide/DADM copolymer (50/50 weight ratio) | 6 | 4.4 | 26.0 (25.65)* |
| 4C | 95/5 acrylamide/DADM copolymer | 6 | 0.98 | 25.2 |
| 5C | PAE/95/5 acrylamide/DADM copolymer (90/10 weight ratio) | 6 | 5.7 | 26.2 (25.65)* |
| 6C | None (Blank) | 7.5 | 0.9 | 22.6 |
| 7C | PAE (Comparable) | 7.5 | 5.9 | 24.9 |
| 8 | PAE/95/5 acrylamide/DADM copolymer (50/50 weight ratio) | 7.5 | 4.5 | 26.5 (24.5)* |

TABLE 1-continued

| No. | Polymer | pH | Immediate Wet Strength, lb./in. | Dry Strength, lb./in. |
|---|---|---|---|---|
| 9C | 95/5 acrylamide/DADM co-polymer | 7.5 | 0.9 | 24.6 |
| 10C | PAE/95/5 acrylamide/DADM copolymer (90/11 0 weight ratio) | 7.5 | 5.95 | 25.2 (24.5)* |

C: Comparative
*Expected Dry Strength based on rule of mixtures is shown in parentheses

EXAMPLES 11–20

Blends of the wet strength agents and dry strength agents shown in Table 2 were prepared by the General Blend Preparation Procedure and diluted to the indicated polymer solids level. The bulk viscosities of the resulting polymer solutions were determined after the one hour stirring period (time=0), then stored in ovens at the temperatures indicated. Samples were periodically withdrawn thereafter for bulk viscosity measurements using a Brookfield viscometer having the appropriate spindles, until gelation was observed. Bulk viscosity is reported in units of centipoise (cps). The results shown in Table 2 demonstrate which blend samples, prepared by mixing dry strength agent and wet strength agent in water to provide a 15% solids composition, by weight based on total weight, remained pourable for at least about 25 days after preparation when stored at about 35° C. The results also demonstrate that blends having higher solids tend to gel more quickly than blends having lower solids, and that blends stored at higher temperatures tend to gel more quickly than blends stored at lower temperatures. The results also demonstrate that blends containing permanent wet strength agents such as 95/5 acrylamide/DADM copolymer tend to have greater stability than blends which contain more reactive components such as MF or glyoxalated polyacrylamide.

TABLE 2

| No. | Storage Time, Days | Storage Temp., ° C. | Polymer Solids, % | Polymer Blend | Bulk Viscosity, cps |
|---|---|---|---|---|---|
| 11 | 0 | 25 | 15 | PAE/95/5 acrylamide/DADM copolymer (50/50 weight ratio) | 265 |
| 12 | 31 | 25 | 15 | PAE/95/5 acrylamide/DADM copolymer (50/50 weight ratio) | 292 |
| 13 | 47 | 25 | 15 | PAE/95/5 acrylamide/DADM copolymer (50/50 weight ratio) | 335 |
| 14 | 62 | 25 | 15 | PAE/95/5 acrylamide/DADM copolymer (50/50 weight ratio) | 383 |
| 15 | 0 | 25 | 17 | PAE/95/5 acrylamide/DADM copolymer (50/50 weight ratio) | 415 |
| 16 | 31 | 25 | 17 | PAE/95/5 acrylamide/DADM copolymer (50/50 weight ratio) | 525 |
| 17 | 47 | 25 | 17 | PAE/95/5 acrylamide/DADM copolymer (50/50 weight ratio) | 630 |
| 18 | 62 | 25 | 17 | PAE/95/5 acrylamide/DADM copolymer (50/50 weight ratio) | 795 |

TABLE 2-continued

| No. | Storage Time, Days | Storage Temp., ° C. | Polymer Solids, % | Polymer Blend | Bulk Viscosity, cps |
|---|---|---|---|---|---|
| 19 | 0 | 25 | 19 | PAE/95/5 acrylamide/DADM copolymer (50/50 weight ratio) | 660 |
| 20 | 31 | 25 | 19 | PAE/95/5 acrylamide/DADM copolymer (50/50 weight ratio) | 930 |
| 21 | 47 | 25 | 19 | PAE/95/5 acrylamide/DADM copolymer (50/50 weight ratio) | 1250 |
| 22 | 62 | 25 | 19 | PAE/95/5 acrylamide/DADM copolymer (50/50 weight ratio) | gelled, not pourable |
| 23 | 0 | 35 | 15 | PAE/95/5 acrylamide/DADM copolymer (50/50 weight ratio) | 265 |
| 24 | 17 | 35 | 15 | PAE/95/5 acrylamide/DADM copolymer (50/50 weight ratio) | 465 |
| 25 | 23 | 35 | 15 | PAE/95/5 acrylamide/DADM copolymer (50/50 weight ratio) | 760 |
| 26 | 29 | 35 | 15 | PAE/95/5 acrylamide/DADM copolymer (50/50 weight ratio) | 1030 |
| 26 | 31 | 35 | 15 | PAE/95/5 acrylamide/DADM copolymer (50/50 weight ratio) | gelled, not pourable |
| 27 | 0 | 35 | 17 | PAE/95/5 acrylamide/DADM copolymer (50/50 weight ratio) | 415 |
| 28 | 17 | 35 | 17 | PAE/95/5 acrylamide/DADM copolymer (50/50 weight ratio) | 999 |
| 29 | 23 | 35 | 17 | PAE/95/5 acrylamide/DADM copolymer (50/50 weight ratio) | 2770 |
| 30 | 27 | 35 | 17 | PAE/95/5 acrylamide/DADM copolymer (50/50 weight ratio) | gelled, not pourable |
| 31 | 0 | 35 | 19 | PAE/95/5 acrylamide/DADM copolymer (50/50 weight ratio) | 660 |
| 32 | 17 | 35 | 19 | PAE/95/5 acrylamide/DADM copolymer (50/50 weight ratio) | gelled, not pourable |
| 33C | 0 | 35 | 12.5 | PAE/glyoxalated poly-acrylamide (50/50 weight ratio) | 81 |
| 34C | 24 | 35 | 12.5 | PAE/glyoxalated poly-acrylamide (50/50 weight ratio) | gelled, not pourable |
| 35C | 0 | 35 | 13.5 | PAE/glyoxalated poly-acrylamide (50/50 weight ratio) | 131 |
| 36C | 19 | 35 | 13.5 | PAE/glyoxalated poly-acrylamide (50/50 weight ratio) | gelled, not pourable |
| 37C | 0 | 25 | 8.5 | MF/95/5 acrylamide/DADM copolymer (50/50 weight ratio) | 43 |
| 38C | 4 | 25 | 8.5 | MF/95/5 acrylamide/DADM copolymer (50/50 weight ratio) | gelled, not pourable |

C: Comparative

EXAMPLES 39–42

A blend was prepared by the General Blend Preparation Procedure, using a commercially available PAE as the wet strength agent and 95/5 acrylamide/DADM copolymer as the dry strength agent, in the proportions indicated in Table 3. Multi-ply paper was formed by the General Multi-Ply Handsheet Procedure at pH 6.5 and at a total polymer dosage of about 5 pounds/ton to form 100 pound basis weight sheets. The results shown in Table 3 demonstrate the amounts of wet strength agent, dry strength agent and paper stock that are effective to provide multi-ply paper with an immediate wet strength that is less than the immediate wet strength of a comparable multi-ply paper in which only the wet strength agent is used in place of the blend, and the amounts of wet strength agent. dry strength agent and paper stock that are effective to provide the multi-ply paper with a dry ply bonding strength that is greater than the expected dry ply bonding strength based on the rule of mixtures.

TABLE 3

| No. | Polymer | Immediate Wet Strength, lb./in. | Dry ply bonding Strength, mil-ft-lb. |
|---|---|---|---|
| 39C | None (Blank) | 1.5 | 104 |
| 40C | PAE (Comparable) | 7.2 | 127 |
| 41 | PAE/95/5 acrylamide/DADM copolymer (50/50 weight ratio) | 5.7 | 132 (127)* |
| 42C | 95/5 acrylamide/DADM copolymer | 1.7 | 127 |

C: Comparative
*Expected Dry Strength based on rule of mixtures is shown in parentheses

EXAMPLES 43–64

A series of blends were prepared by the General Blend Preparation Procedure, using a commercially available PAE as the wet strength agent and 95/5 acrylamide/DADM copolymer as the dry strength agent, in the proportions indicated in Table 4. Paper was formed by the General Handsheet Procedure at a total polymer dosage as shown in Table 4 to form 70 pound basis weight sheets. Comparable paper, in which the wet strength agent alone was used in place of the blend, was also formed by the General Handsheet Procedure at a dosage as shown in Table 4 to form 70 pound basis weight sheets. The pH was about 7.5. The results demonstrate the amounts of wet strength agent, dry strength agent and paper stock that are effective to provide paper with an immediate wet strength that is less than the immediate wet strength of a comparable paper in which only the wet strength agent is used in place of the blend, and the amounts of wet strength agent, dry strength agent and paper stock that are effective to provide the paper with a dry strength that is greater than the expected dry strength based on the rule of mixtures.

TABLE 4

| No. | Polymer | Dosage lb./T | Immediate Wet Strength, lb./in. | Dry Strength, lb./in. |
|---|---|---|---|---|
| 43C | None (Blank) | 0 | 0.29 | 18.78 |
| 44C | PAE (Comparable) | 3 | 3.20 | 23.33 |
| 45C | PAE/95/5 acrylamide/DADM copolymer (60/40 weight ratio) | 3 | 3.29 | 21.65 (22.74)* |
| 46C | PAE/95/5 acrylamide/DADM copolymer (55/45 weight ratio) | 3 | 3.34 | 23.08 (22.66)* |
| 47C | PAE/95/5 acrylamide/DADM copolymer (50/50 weight ratio) | 3 | 3.59 | 21.55 (22.59)* |

TABLE 4-continued

| No. | Polymer | Dosage lb./T | Immediate Wet Strength, lb./in. | Dry Strength, lb./in. |
|---|---|---|---|---|
| 48 | PAE/95/5 acrylamide/DADM copolymer (45/55 weight ratio) | 3 | 3.03 | 22.65 (22.52)* |
| 49 | PAE/95/5 acrylamide/DADM copolymer (40/60 weight ratio) | 3 | 2.98 | 22.55 (22.44)* |
| 50C | 95/5 acrylamide/DADM copolymer | 3 | 0.4 | 21.85 |
| 51C | PAE (Comparable) | 6 | 5.82 | 25.46 |
| 52C | PAE/95/5 acrylamide/DADM copolymer (60/40 weight ratio) | 6 | 4.05 | 22.94 (23.52)* |
| 53 | PAE/95/5 acrylamide/DADM copolymer (55/45 weight ratio) | 6 | 4.67 | 24.64 (23.27)* |
| 54C | PAE/95/5 acrylamide/DADM copolymer (50/50 weight ratio) | 6 | 3.55 | 22.87 (23.03)* |
| 55 | PAE/95/5 acrylamide/DADM copolymer (45/55 weight ratio) | 6 | 4.16 | 24.84 (22.79)* |
| 56 | PAE/95/5 acrylamide/DADM copolymer (40/60 weight ratio) | 6 | 3.97 | 23.15 (22.54)* |
| 57C | 95/5 acrylamide/DADM copolymer | 6 | 0.5 | 20.6 |
| 58C | PAE (Comparable) | 9 | 6.02 | 25.67 |
| 59C | PAE/95/5 acrylamide/DADM copolymer (60/40 weight ratio) | 9 | 4.37 | 24.39 (24.43)* |
| 60 | PAE/95/5 acrylamide/DADM copolymer (55/45 weight ratio) | 9 | 4.84 | 24.32 (24.27)* |
| 61 | PAE/95/5 acrylamide/DADM copolymer (50/50 weight ratio) | 9 | 4.82 | 24.26 (24.12)* |
| 62 | PAE/95/5 acrylamide/DADM copolymer (45/55 weight ratio) | 9 | 4.94 | 25.56 (23.96)* |
| 63 | PAE/95/5 acrylamide/DADM copolymer (40/60 weight ratio) | 9 | 4.48 | 25.19 (23.80)* |
| 64C | 95/5 acrylamide/DADM copolymer | 9 | 0.65 | 22.56 |

C: Comparative
*Expected Dry Strength based on rule of mixtures is shown in parentheses

EXAMPLES 65–68

Two blends were prepared by the General Blend Preparation Procedure using the components and proportions indicated in Table 5. Recycled fiber pulp obtained from a commercial paper mill was used to form 100 pound basis weight multi-ply paper sheets by following the General Multi-Ply Handsheet Procedure at pH 7.0 and at a total polymer dosage of about 10 pounds/ton. The dry ply bonding strength results shown in Table 6 demonstrate the performance advantages of a 50/50 blend of PAE and 95/5 acrylamide/DADM copolymer.

TABLE 5

| No. | Polymer | Dry ply bonding Strength, mil ft.-lb. |
|---|---|---|
| 65 | None (Blank) | 57 |
| 66 | 95/5 acrylamide/DADM copolymer | 56 |
| 67 | PAE/95/5 acrylamide/DADM copolymer (50/50 weight ratio) | 83 |

TABLE 5-continued

| No. | Polymer | Dry ply bonding Strength, mil ft.-lb. |
|---|---|---|
| 68 | PAE/glyoxalated polyacrylamide (50/50 weight ratio) | 69 |

C: Comparative

EXAMPLES A–F

Paper was formed by the General Handsheet Procedure at pH 6 using a series of commercially available dry strength agents and cationic promoters at a total polymer dosage of about 10 pounds/ton to form 50 pound basis weight sheets. As shown in Table 6, cationic promoters such as Cypro® 514 cationic promoter and Cypro® 515 cationic promoter do not increase the dry strength of paper by 10% or more and hence are not dry strength agents for the purposes of the instant invention.

TABLE 6

| No. | Polymer | Dry Strength, lb./in. | Percentage Increase in Strength over Blank |
|---|---|---|---|
| A | None (Blank) | 21.7 | N/A |
| B | Cypro 514 ® cationic promoter | 22.2 | 2 |
| C | Cypro 515 ® cationic promoter | 23.4 | 8 |
| D | 95/5 acrylamide/DADM copolymer | 25.0 | 15 |
| E | MF (melamine-formaldehyde) | 25.2 | 16 |
| F | MF/95/5 acrylamide/DADM copolymer (50/50 weight ratio) | 25.7 | 18 |

We claim:

1. A composition comprised of (a) a polymeric cationic wet strength agent, (b) a synthetic polymeric cationic dry strength agent different from said (a), having from about 1 to about 15% of cationic recurring units, by mole based on total moles of recurring units, wherein said synthetic polymeric cationic dry strength agent increases the wet strength of paper by about 15% or less, and (c) water, wherein the weight ratio of said (a) to said (b) is in the range of about 1:4 to 4:1, and wherein a sample of said composition, prepared by mixing (a) and (b) in water to provide a 15% solids composition, by weight based on total weight, remains pourable for at least about 25 days after preparation when stored at about 35° C.

2. A composition as claimed in claim 1 wherein said (a) is selected from the group consisting of polyamine epichlorohydrin, polyamide epichlorohydrin, and polyamine-amide epichlorohydrin.

3. A composition as claimed in claim 1 wherein said (b) is a cationic polyacrylamide.

4. A composition as claimed in claim 3 wherein said cationic polyacrylamide is comprised of diallyldimethylammonium chloride recurring units.

5. A composition comprised of (a) from about 1% to about 15%, by weight based on total, of a cationic wet strength agent selected from the group consisting of polyamine epichlorohydrin, polyamide epichlorohydrin, and polyamine-amide epichlorohydrin, (b) from about 1% to about 15%, by weight based on total, of a cationic polyacrylamide comprised of from about 1 to about 15% of diallyldimethylammonium chloride recurring units, by mole based on total moles of recurring units, and (c) water, wherein the weight ratio of said (a) to said (b) is in the range of about 2:3 to 3:2, and wherein a sample of said composition, prepared by mixing (a) and (b) in water to provide a 15% solids composition, by weight based on total weight, remains pourable for at least about 25 days after preparation when stored at about 35° C.

* * * * *